US005920921A

United States Patent [19]

Poole

[11] Patent Number: 5,920,921

[45] Date of Patent: Jul. 13, 1999

[54] LIGHTED SWIMMING POOL PLATFORM ASSEMBLY

[76] Inventor: David A. Poole, 2740 49$^{th}$ Street N., St. Pete, Fla. 33710

[21] Appl. No.: 08/987,749

[22] Filed: Dec. 9, 1997

Related U.S. Application Data

[51] Int. Cl.$^{6}$ ..... E04H 4/00

[52] U.S. Cl. ..... 4/496; 4/504

[58] Field of Search ..... 4/496, 488, 495, 4/504, 506, 513

[56] References Cited

U.S. PATENT DOCUMENTS

| | | | |
|---|---|---|---|
| 3,813,703 | 6/1974 | Beaudin, Jr. . | |
| 3,874,005 | 4/1888 | Badon . | |
| 3,935,600 | 2/1976 | Scribner | 4/495 |
| 3,942,198 | 3/1976 | Jewett . | |
| 4,008,497 | 2/1977 | Badon . | |
| 4,124,906 | 11/1978 | Millard et al. . | |
| 4,271,542 | 6/1981 | Wood et al. . | |
| 4,980,934 | 1/1991 | Dahowski et al. | 4/496 |
| 5,657,589 | 8/1997 | De Bood | 4/496 |

*Primary Examiner*—David J. Walczak
*Attorney, Agent, or Firm*—Kenneth L. Tolar

[57] ABSTRACT

A swimming pool platform assembly particularly suitable for above ground pools includes a square planar platform having upper and lower surfaces. Attached to the lower surface of the support platform is a frame component for suspending the support platform a predetermined distance above the swimming pool bottom surface. The frame component comprises a substantially square upper frame member formed from a plurality of interconnected tubular members and a substantially square lower frame member similar to the upper frame member. The upper and lower frame members are relatively spaced a predetermined distance and are interconnected with shorter vertical tubular members to form a cage type support structure. Each of the tubular members has a plurality of apertures thereon allowing them to fill with water so that the device sinks to the bottom of the swimming pool. Attached to the lower surface of the support platform are one or more swimming pool lights for illuminating the platform and the pool allowing the device to be easily seen at night. Each corner of the lower frame member may be equipped with rubber gripping members for frictionally engaging the bottom surface of a swimming pool.

14 Claims, 1 Drawing Sheet

LIGHTED SWIMMING POOL PLATFORM ASSEMBLY

BACKGROUND OF THE INVENTION

The present invention relates to a lighted swimming pool platform assembly which may be easily positioned on the bottom of an above ground swimming pool allowing small children to stand thereon with their heads above the surface of the water. The device includes a platform having swimming pool lights attached thereto supported by a lightweight, hollow unitary frame having a plurality of apertures on its exterior surface. Accordingly, when the device is placed in water, it quickly sinks to the swimming pool bottom surface eliminating the need for support legs or attachment means.

DESCRIPTION OF THE PRIOR ART

Most below ground swimming pools have a shallow area for smaller children with a minimum water depth of approximately 3 feet. Above ground swimming pools typically have a uniform depth with no shallow areas. Regardless, the shallow area of a below ground swimming pool or the depth of an above ground swimming pool are often deeper than the average height of smaller children. Accordingly, children who are shorter than the water depth cannot stand on the bottom of the pool with their heads above the surface of the water. This poses a significant safety risk since most children within this age group are typically not good swimmers. Additionally, even if the child can swim, the child and the parents still feel more secure when the child can stand on the bottom of the pool with his or her head above the surface of the water.

Numerous attempts have been made to address the above described concerns. For example, U.S. Pat. No. 4,124,906 issued to Malard relates to a child's crib for use in a pool. The crib is supported a predetermined distance above a pool bottom surface by a plurality of vertical support legs. Horizontally disposed between the support legs are poles having a plurality of apertures thereon to prevent the device from floating. Although the device relates to a sinkable structure, it is formed from a plurality of interconnected components which are difficult and inconvenient to assemble. Furthermore, the device relates to a crib, as opposed to a platform, which is primarily designed for infants and is inappropriate for older children. Finally, the device does not include a light means allowing it to be easily seen and used at night.

U.S. Pat. No. 3,874,005 issued to Badon relates to a swimming pool safety playpen that may be either floated in the water or attached to the bottom of a swimming pool using vertically adjustable legs.

U.S. Pat. No. 4,008,497 issued to Badon relates to a method of providing a safe environment using the device described in U.S. Pat. No. 3,874,005 issued to Badon, supra.

U.S. Pat. No. 3,813,703 issued to Beaudin, Jr. discloses a swimming pool wading platform having a pair of legs for resting on the bottom of a swimming pool and a second set of legs that rest on the edge of the pool. The height of the platform may be adjusted to a desired depth.

U.S. Pat. No. 4,271,542 issued to Wood et al discloses a floating swimming pool platform which permits water passage vertically therethrough and which is constantly urged toward the water surface.

U.S. Pat. No. 3,942,198 issued to Jewett relates to a safety baffling for placement immediately adjacent diver exit portions of water slides and/or diving boards.

Each of the above described devices are inadequate for several reasons. The prior art platforms discussed above are designed to either float or are supported on the swimming pool floor using a plurality of adjustable support legs or similar support means. The support legs are removably attached to the platform which is cumbersome, inconvenient and potentially dangerous. Attachable support legs always pose a safety risk since they can become disconnected causing the platform to collapse. The above described devices further include many detachable components which are difficult and inconvenient to assemble or transport. Additionally, users will often swim at night at which time conventional platforms supported below the water surface such as those described above will be difficult, if not impossible, to see. Accordingly, there is a need for a unitary lighted swimming pool platform assembly which may be quickly and conveniently supported on a swimming pool bottom without support legs or attachment means.

The present invention overcomes the above enumerated shortcomings by providing a unitary device including a platform supported by a lightweight frame component having apertures thereon allowing the device to be quickly and easily sunk to the bottom of the swimming pool. The device is easy to transport and requires no assembly prior to use. Although the device disclosed in Mallard relates to a lower support surface having apertures thereon for preventing the device from floating, the device is a crib as opposed to a platform supported by a plurality of elongated support legs attached to the crib using pins thereby posing a risk as described above. The device contains numerous removably attached components which must be assembled prior to use. Finally, the device does not have a light means or a similar device for selectively illuminating the device when used at night.

The present invention provides a pool platform having one or more integral swimming pool lights allowing a user to easily see the platform when swimming at night. Also, the integral swimming pool lights illuminate the entire pool thereby providing a portable underwater lighting device for above ground swimming pools.

SUMMARY OF THE INVENTION

The present invention relates to a swimming pool platform assembly that overcomes the disadvantages of the prior art which is particularly designed for above ground swimming pools. The device includes a planar, substantially square support platform which is suspended a predetermined distance above the bottom surface of a swimming pool by a frame component comprising an upper and a lower frame member. Each frame member has a substantially square configuration and is formed with a plurality of lightweight plastic tubular members each having a plurality of apertures thereon. The apertures allow the frame component to completely fill with water so that the device quickly and easily sinks to the bottom of a swimming pool. Each side and corner of the upper frame member is attached to a corner and a side of the lower frame member with a vertical hollow tubular member similar to those used in forming the frame members. The various tubular members are interconnected using T's and elbows to form a sturdy, unitary structure that requires no assembly. Attached to the lower surface of the support platform are a plurality of battery powered swimming pool lights of the type generally known in the prior art for illuminating the device at night. Disposed between the upper and lower frame members and attached to the vertical tubular members is a substantially square continuous plexiglass border having any one of a number of design elements imprinted or embossed thereon. The plexiglass border provides a rigid planar sidewall that further enhances the aesthetic quality of the device when the lights shine therethrough. It is therefore an object of the present invention to provide a swimming pool platform suspended by an integral lightweight frame component that quickly and easily sinks to the bottom of a swimming pool when placed therein eliminating the need for detachable support legs or similar devices.

It is yet another object of the present invention to provide a swimming pool platform having integral lights for selectively illuminating the device and/or a swimming pool allowing the device to be easily seen at night.

It is yet another object of the present invention to provide a swimming pool platform which also functions as a portable light means for an above ground swimming pool.

It is yet another object of the present invention to provide a unitary lightweight swimming pool platform which is easy to install within a swimming pool. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
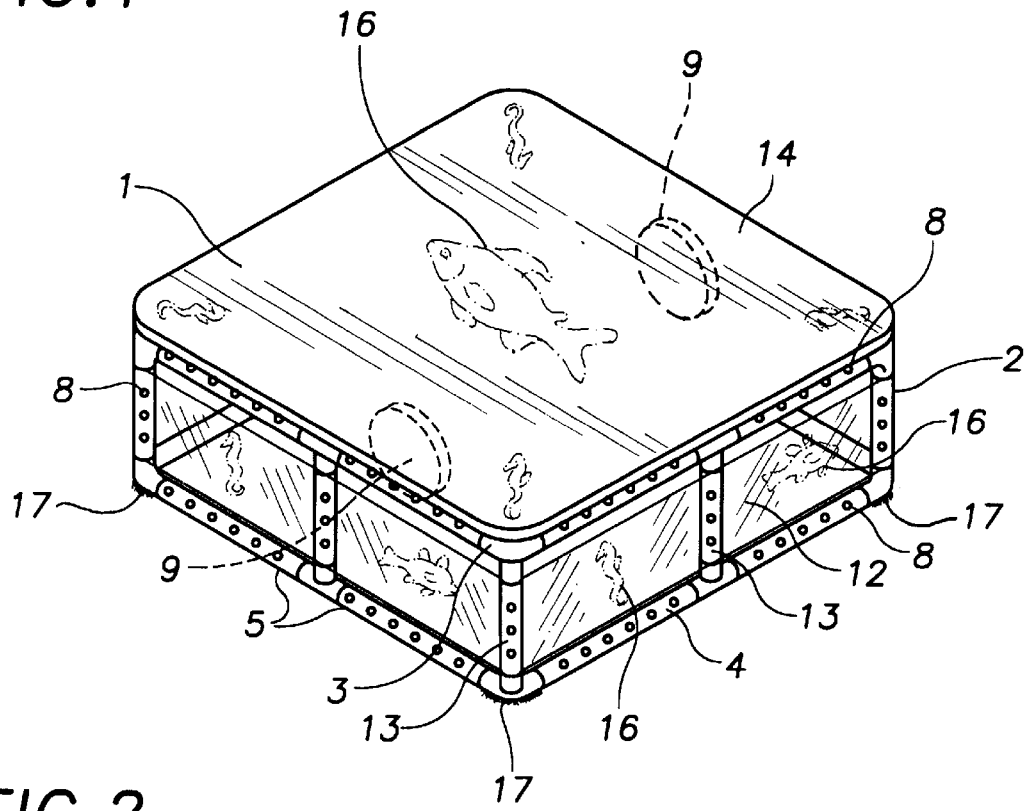
FIG. 1 depicts the inventive device with a pair of swimming pool lights depicted in phantom.
Figure 2:
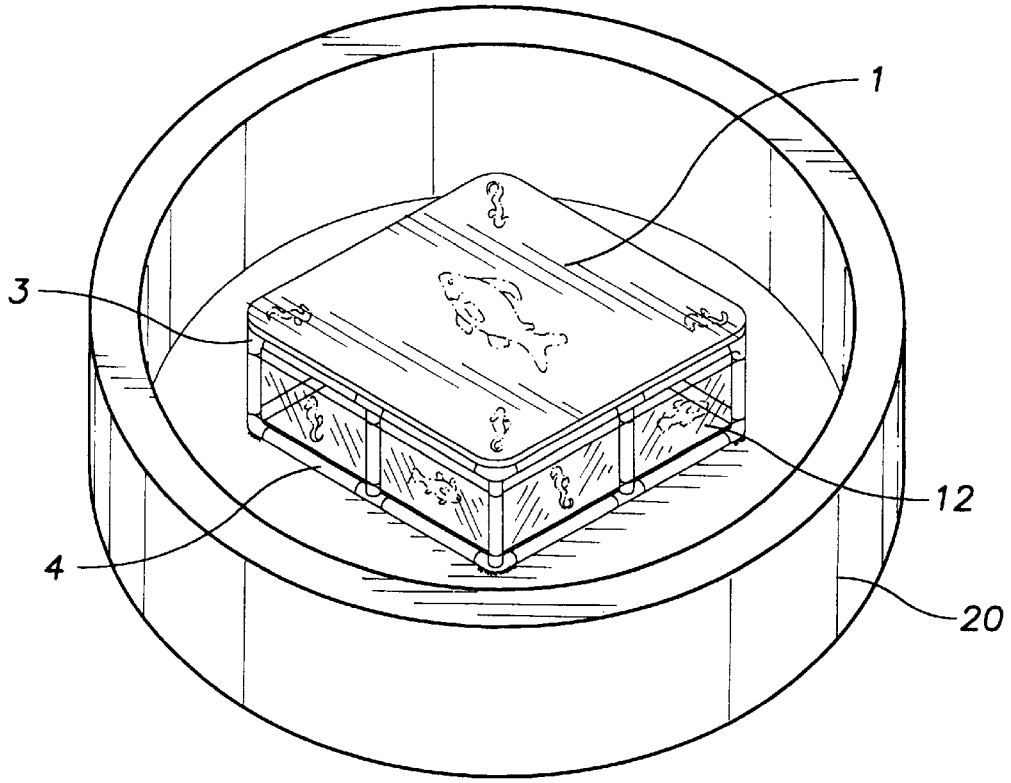
FIG. 2 depicts the inventive device submerged in an above ground swimming pool.

Referring now to FIGS. 1 through 2, the present invention relates to a platform particularly suitable for use in above ground swimming pools 20. The device comprises a substantially square planar support platform 1 having upper 1A and lower surfaces. The support platform 1 is supported by a two-tiered frame component 2 comprising an upper frame member 3 and a lower frame member 4. Each frame member 3,4 is substantially square having four sides with four corners therebetween and is fabricated with a plurality of hollow tubular members 5 made from PVC plastic or a similar lightweight material. The tubular members are preferably joined using T's and elbows although any other suitable attachment means may be used or the frame members may be a unitary structure without individual components.

The upper frame member 3 is superimposed above and vertically aligned with the lower frame member and is spaced a predetermined distance therefrom. Each side and each corner of the upper frame member 3 is connected to a side of the lower frame member with a vertical tubular member 13 having a T at each end thereof. Each tubular member 5,13 has a plurality of apertures 8 thereon so that the frame members quickly fill with water when placed in a swimming pool. Accordingly, the lightweight frame component 2 and attached support platform 1 will quickly sink and will remain on the bottom surface of a pool when placed therein. Likewise, when the device is removed from the pool or the pool is drained water will easily drain from the frame component. Accordingly, the apertures are preferably circumferentially disposed about the tubular members.

Attached to the lower surface of the support platform 1 are one or more waterproof swimming pool lights 9 of the type generally known in the prior art. The lights 9 are preferably powered by a battery means (not pictured) and would be selectively illuminated using a switch (not pictured) disposed on the frame component or support platform. The swimming pool lights 9 serve the dual purpose of allowing the device to be easily seen at night while also functioning as a portable lighting device for an above ground swimming pool. In the preferred embodiment, two oppositely facing swimming pool lights 9 are included so that both sides of the platform are completely illuminated. However, as will be readily apparent to those skilled in the art, any number of conventional attachment means may be used to secure the lights to the bottom surface of the platform. The switch and battery means are stored within a water tight compartment.

Disposed between the upper 3 and lower 4 frame members and attached to the vertical tubular members 13 is a continuous substantially square planar plexiglass border 12 preferably having any one of a number of design elements 16 embossed or imprinted theron. The transparent border functions as a flat, smooth decorative sidewall for the frame component while allowing light to shine therethrough. Any one of a number of design elements may likewise be embossed or imprinted on the upper surface of the support platform.

In another embodiment of the present invention, the device may be equipped to be used in a below ground pool by attaching a rubber gripping member 17 to the bottom surface of each lower frame member corner to prevent the device from sliding to the deep end of the pool. The rubber gripping member 17 may be of any type generally known in the prior art and preferably comprises a rubber pad with a plurality of projections integrally protruding therefrom.

The device is preferably fabricated with a lightweight plastic or similar material although the size, shape, color and materials of construction of the various components may be varied to suit a particular application. The support platform may also be constructed with a lightweight transparent material similar to that of the border. The relative distance between the upper and lower frame members, and thus the vertical distance between the support platform and the swimming pool bottom, may be varied by using vertical tubular members of a desired length. Likewise, the lateral dimensions of the frame and support platform may be varied to suit a particular application.

Although there has been shown and described the preferred embodiment of the present invention, it will be readily apparent to those skilled in the art that modifications may be made thereto which do not exceed the scope of the claims. Therefore, the scope of the invention is only to be limited by the following appended claims.

What is claimed is:

1. A swimming pool platform assembly for resting on the bottom surface of a swimming pool comprising:

a substantially square support platform having an upper and a lower surface;

a hollow frame component attached to the lower surface of the support platform for suspending said platform a predetermined distance above the bottom surface of the swimming pool, said frame component comprising substantially square upper and lower frame members, each frame member having four sides and four corners therebetween and formed from a plurality of interconnected hollow tubular members, said frame component further comprising a plurality of vertical tubular members disposed between said upper and lower frame members so that said upper frame member is superimposed on and substantially vertically aligned with said lower frame member and spaced a predetermined distance therefrom, said frame component having a plurality of apertures for filling said frame component with water when said frame component is submerged therein, thereby eliminating the buoyancy of said frame component;

a waterproof swimming pool light attached to the lower surface of the support platform for allowing a user to easily see the platform at night whereby a user less than a predetermined height may stand on the support platform to elevate the user's head above a water surface having a specified depth.

2. A device according to claim 1 further comprising a substantially square border attached to and surrounding said frame component providing a rigid planar sidewall therefor.

3. A device according to claim 2 wherein said border is transparent allowing light to pass therethrough.

4. A device according to claim 2 wherein said border has a design element embossed thereon.

5. A swimming pool platform assembly according to claim 1 further comprising a plurality of gripping members attached to the bottom surface of said lower frame component, at each corner thereof, for frictionally engaging the bottom surface of said swimming pool to prevent the platform assembly from sliding thereon.

6. A swimming pool platform assembly for resting on the bottom surface of a swimming pool comprising:

a substantially square support platform having upper and lower surfaces;

a hollow frame component attached to the lower surface of the support platform for suspending the platform a predetermined distance above the swimming pool bottom surface, said frame component having a plurality of apertures for filling said frame component with water when said frame component is submerged therein, thereby eliminating the buoyancy of said frame component;

a substantially square border attached to and surrounding said frame component, providing a rigid substantially planar sidewall therefor;

a waterproof swimming pool light attached to the lower surface of the support platform for allowing a user to easily see the platform at night whereby a user less than a predetermined height may stand on said support platform to elevate the user's head above a water surface having a specified depth.

7. A swimming pool platform assembly according to claim 6 wherein said border is transparent allowing light to pass therethrough.

8. A swimming pool platform assembly according to claim 6 wherein said border has a design element embossed thereon.

9. A swimming pool platform assembly for resting on the bottom surface of a swimming pool comprising:

a substantially square support platform having upper and lower surfaces;

a substantially square horizontally disposed hollow frame component attached to the lower surface of said support platform for suspending said platform a predetermined distance above the bottom surface of the swimming pool, said horizontally disposed hollow frame component having a plurality of apertures for filling said frame component with water thereby eliminating the buoyancy of said frame component, and to allow water to drain from said frame component through said apertures when said frame component is removed from water;

a waterproof swimming pool light attached to the lower surface of said support platform, for illuminating the pool and to allow a user to easily see the platform at night whereby a user less than a predetermined height may stand on said support platform to elevate his or her head above a water surface having a specified depth.

10. A swimming pool platform assembly according to claim 9 wherein said frame component comprises:

a substantially square horizontal upper frame member having four sides and four corners therebetween, formed from a plurality of interconnected hollow tubular members;

a substantially square horizontal lower frame member formed from a plurality of interconnected hollow tubular members, said lower frame member having four sides and four corners therebetween an upper surface and a lower surface;

a plurality of vertical tubular members disposed between said upper and lower frame members so that said upper frame member is superimposed on and substantially vertically aligned with said lower frame member and spaced a predetermined distance therefrom.

11. A swimming pool platform assembly according to claim 10 further comprising a substantially square border attached to and surrounding said frame component providing a rigid substantially planar sidewall therefor.

12. A swimming pool platform assembly according to claim 11 wherein said border is transparent allowing light to pass therethrough.

13. A swimming pool platform assembly according to claim 11 wherein said border has a design element embossed thereon.

14. A swimming pool platform assembly according to claim 11 further comprising a plurality of gripping members attached to the bottom surface of the lower frame component for frictionally engaging the bottom surface of said swimming pool to prevent the platform assembly from sliding thereon.

* * * * *